US006942260B2

(12) United States Patent
Bücker et al.

(10) Patent No.: US 6,942,260 B2
(45) Date of Patent: Sep. 13, 2005

(54) CLOSING DEVICE FOR A VEHICLE DOOR

(75) Inventors: Rolf Bücker, Coburg (DE); Thomas Flecke, Bamberg (DE); Gerhard Hofmann, Untersiemau (DE)

(73) Assignee: Brose Fahrzeugteile GmbH & Co. KG, Coburg (DE)

( * ) Notice: Subject to any disclaimer, the term of this patent is extended or adjusted under 35 U.S.C. 154(b) by 0 days.

(21) Appl. No.: 10/344,299

(22) PCT Filed: Aug. 9, 2001

(86) PCT No.: PCT/DE01/03036

§ 371 (c)(1),
(2), (4) Date: Feb. 7, 2003

(87) PCT Pub. No.: WO02/14636

PCT Pub. Date: Feb. 21, 2002

(65) Prior Publication Data

US 2003/0155780 A1 Aug. 21, 2003

(30) Foreign Application Priority Data

Aug. 11, 2000 (DE) ..... 100 41 498

(51) Int. Cl.[7] ..... E05B 3/00
(52) U.S. Cl. ..... 292/336.3; 292/DIG. 65
(58) Field of Search ..... 292/DIG. 65, 347, 292/348, 336.3, DIG. 22, DIG. 62; 74/551.3

(56) References Cited

U.S. PATENT DOCUMENTS

| | | | | |
|---|---|---|---|---|
| 2,804,330 A | * | 8/1957 | Ogley | 292/186 |
| 3,203,721 A | | 8/1965 | Priestman | |
| 3,848,909 A | | 11/1974 | Foley | |
| 4,508,379 A | * | 4/1985 | Mochida | 292/336.3 |
| 4,796,934 A | * | 1/1989 | Kesel et al. | 292/336.3 |
| 4,995,654 A | * | 2/1991 | Nishigami et al. | 292/216 |
| 5,669,642 A | * | 9/1997 | Kang | 292/336.3 |
| 5,857,386 A | * | 1/1999 | Ruhlman | 74/502.4 |
| 6,067,869 A | | 5/2000 | Chilla et al. | |
| 6,135,514 A | * | 10/2000 | Kowalewski et al. | 292/216 |

FOREIGN PATENT DOCUMENTS

| | | |
|---|---|---|
| DE | 33 24 162 C2 | 1/1985 |
| DE | 196 19 869 A1 | 12/1996 |
| DE | 197 44 384 A1 | 7/1998 |
| DE | 197 19 999 C2 | 11/1998 |
| DE | 198 26 778 A1 | 12/1999 |
| DE | 198 58 416 A1 | 6/2000 |
| DE | 199 01 279 A1 | 7/2000 |
| DE | 199 12 682 A1 | 9/2000 |
| WO | WO 95/32349 | 11/1995 |

OTHER PUBLICATIONS

International Search Report of PCT/DE01/03036, dated Jan. 7, 2002.
International Preliminary Examination Report of PCT/DE01/03036, dated Aug. 21, 2002.
English translation of International Preliminary Examination Report for corresponding International Application PCT/DE01/03036 filed Aug. 9, 2001.

* cited by examiner

*Primary Examiner*—Gary Estremsky
(74) *Attorney, Agent, or Firm*—Christie, Parker & Hale, LLP

(57) ABSTRACT

A closing device for a vehicle door includes a doorlock, an operating element for operating the doorlock, an external door handle fixed to the external skin of the vehicle door with an adjuster piece, a deflecting element which translates a movement of the adjuster piece along a first direction into a movement along a second direction and a coupling element by means of which the deflector element acts upon the operating element. The external door handle and the deflecting element are connected to the external skin of the vehicle door, such that they move together with a deformation of the external skin and that the coupling element is provided with means for distance compensation, which permits a movement of the deflector piece relative to the operating element, without the deflecting element acting upon the operating element.

21 Claims, 3 Drawing Sheets

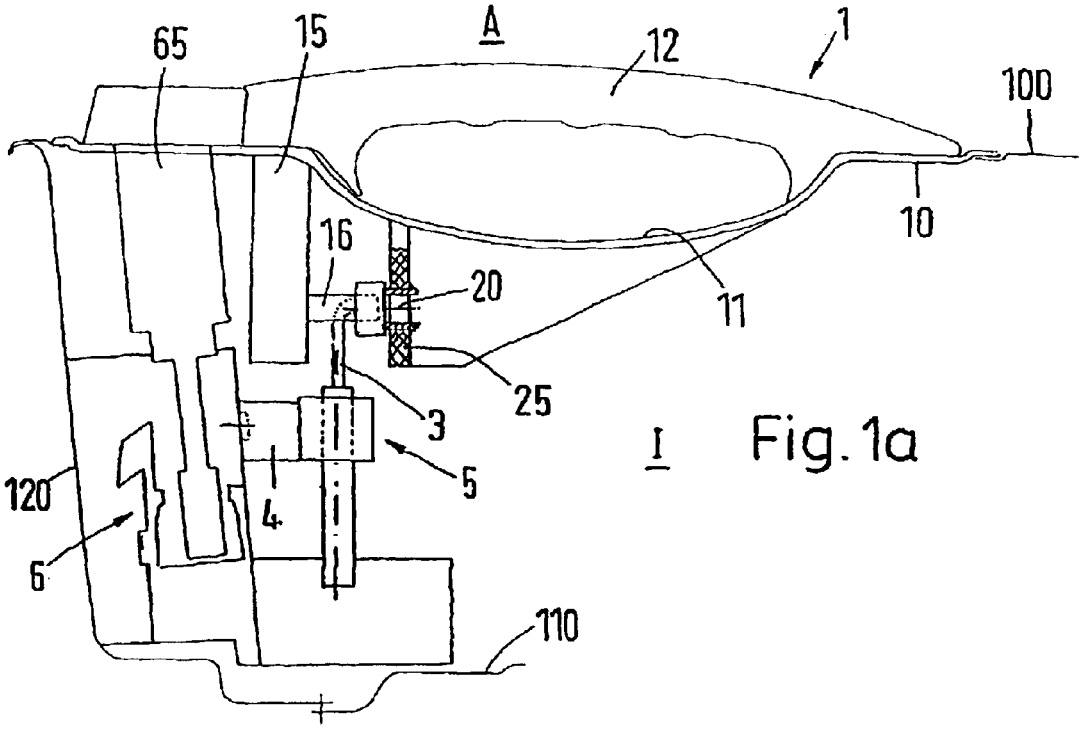
Fig. 1a
Fig. 1b
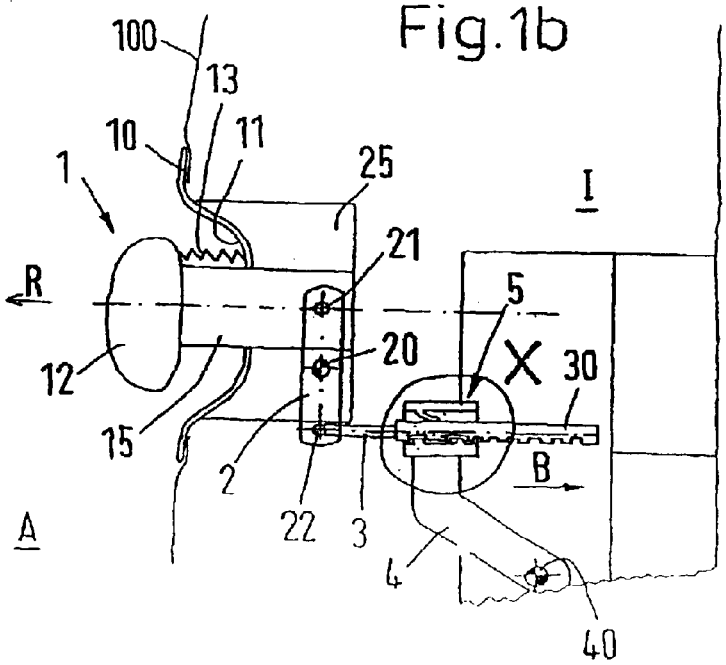
Fig. 1c
(X)
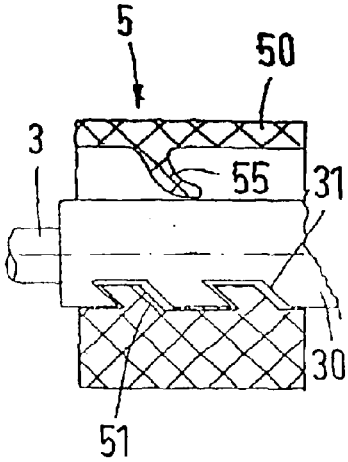

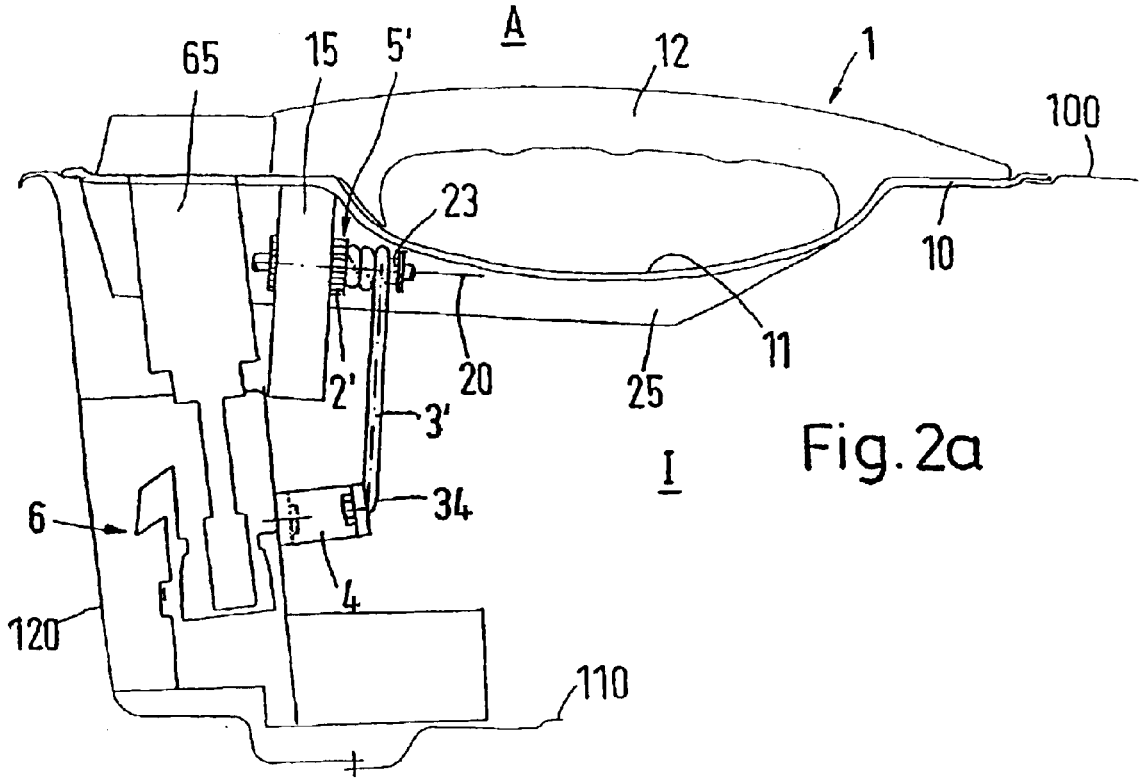
Fig. 2a
Fig. 2b
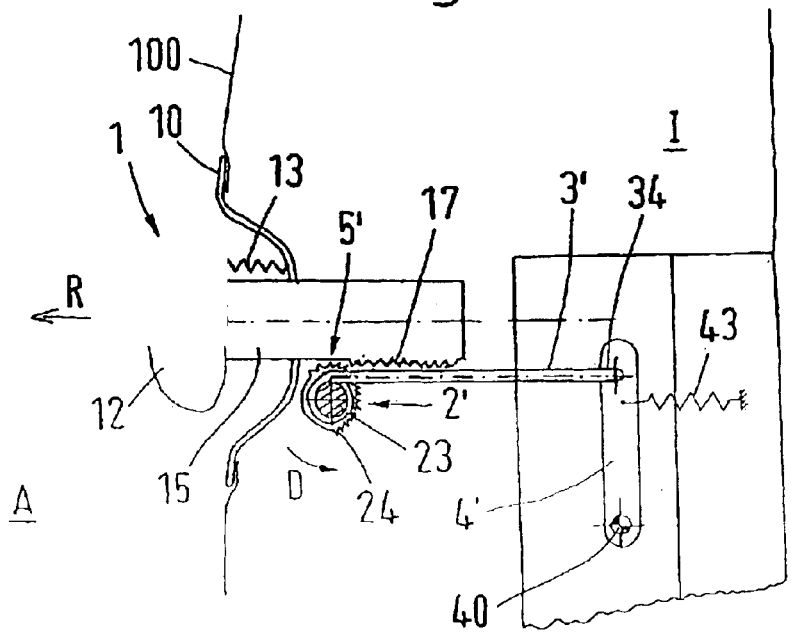

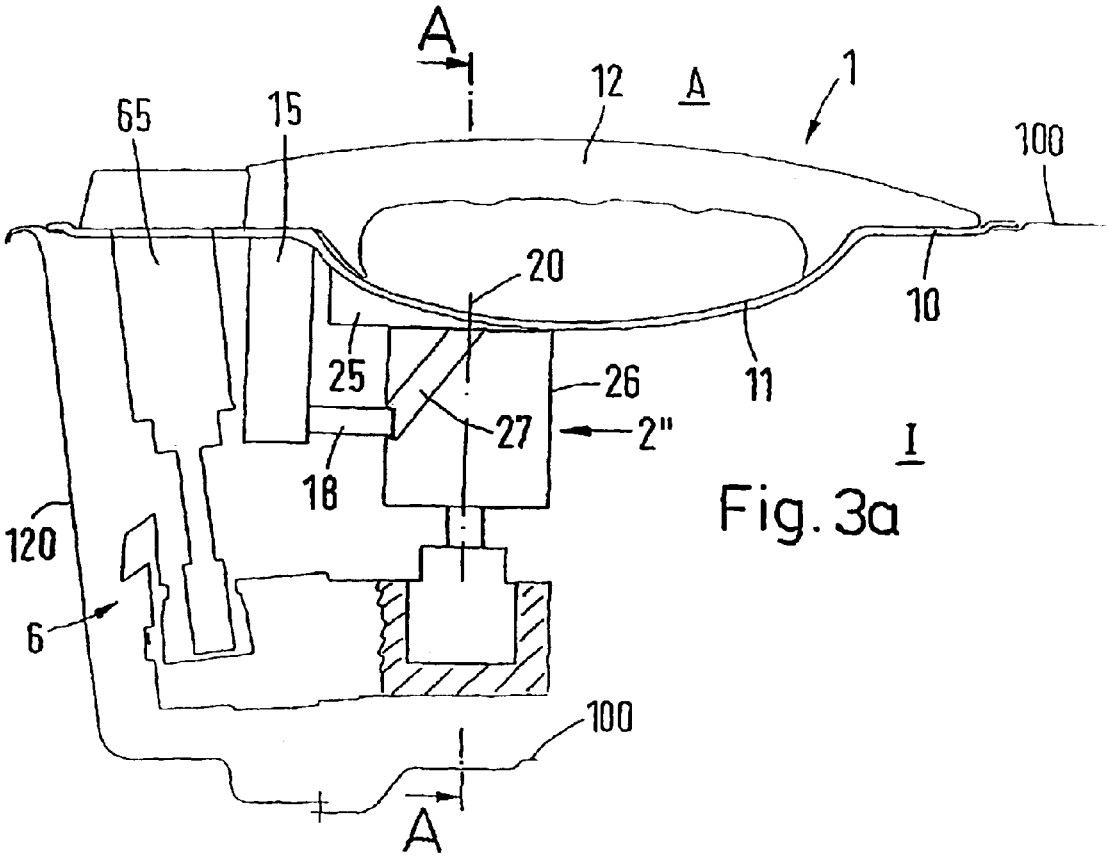
Fig. 3a
Fig. 3b
(A-A)
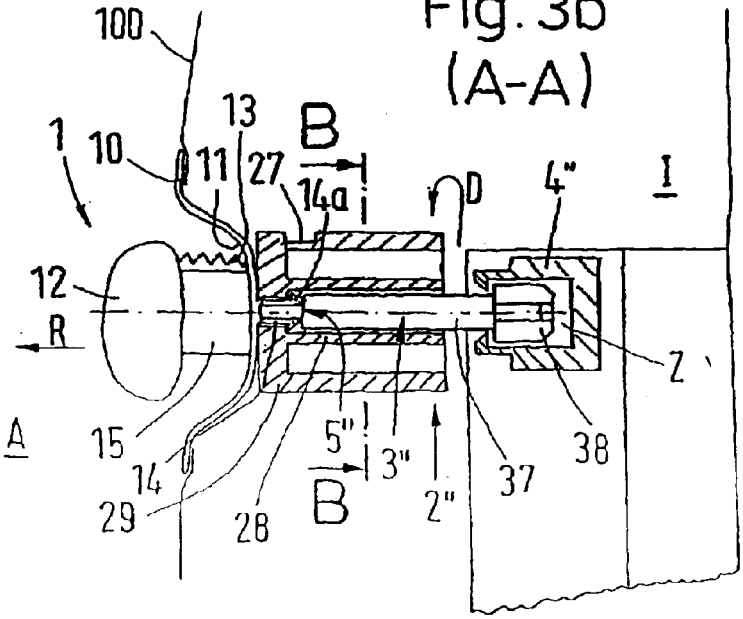
Fig. 3c
(B-B)
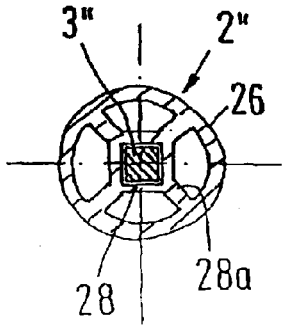

CLOSING DEVICE FOR A VEHICLE DOOR

CROSS-REFERENCE TO RELATED APPLICATION

This application is a National Phase Patent Application of International Application Number PCT/DE01/03036, filed on Aug. 9, 2001, which claims priority of German Patent Application Number 100 41 498.2, filed Aug. 11, 2000.

FIELD OF THE INVENTION

The invention relates to a closing device for a vehicle door wit a door lock, with at least one actuating element for operating the door lock and an external door actuator which is fixed on the outer skin of the vehicle door and which has a movable adjuster part.

BACKGROUND OF THE INVENTION

A closing device for a vehicle door, and having an external door actuator, normally includes an external door handle which is coupled through a force transfer device to an operating element of the door lock in the form of an operating lever. If the door lock is in the unlocked state (e.g. because it has previously been unlocked by a key or remote control), then the door can be opened by means of the external door handle whereby the external handle acts on the door lock through the force transfer device and the operating lever. The operating lever thus interacts with the door lock so that when the door lock is unlocked the door can be opened by means of the external door handle.

A shortcoming associated with such a lock, is that any deformation to the external door skin such as caused by a crash, for example, and transferred to the operating lever would bring the risk of unintended opening of the door in a deformation condition.

DE 197 44 384 A1 provides a closing device for a vehicle door which has a lock with release lever (operating lever) fixed on the inner panel of the vehicle door, and an external door actuator which acts on the release lever through a force transfer element. In order to prevent deformations of the door caused by a crash from transferring to the release lever, the force transfer element is formed as a Bowden cable with excess length. This known closing device, however, has the drawback that the Bowden cable does not occupy a defined position inside the vehicle door because of its excess length.

For a defined guidance of the Bowden cable inside the vehicle door it would therefore be necessary to fix this by means of additional fasteners such as clips. For this purpose the Bowden cable must however be accessible from the interior of the vehicle. This limits the flexibility considerably when assembling the vehicle door. An example here would be fitting the vehicle door where several functional components of the door, such as the door lock and window lever are prefitted on a door module support. Should this door module support be fixed on the inner skin of the vehicle door before the external door actuator is attached to the outer skin and connected to the door lock, then there would not be sufficient access to the Bowden cable from inside the door.

U.S. Pat. No. 3,848,909 describes an operating device for a motor vehicle lock which has a coupling rod for coupling an operating handle to a lever mechanism. The coupling rod is mounted for swivel movement on the side of the operating handle. On the side of the lever mechanism the coupling rod is guided with an engagement element in an oblong hole mounted in the lever mechanism and serving to compensate tolerances.

It would therefore be desirable to provide a closing device for motor vehicles which prevents the unintended release of the operating element of the lock coupled to the external door actuator in the event of deformation to the external door skin and which, at the same time, eliminates the disadvantages of conventional closing devices, as described above.

SUMMARY OF THE INVENTION

To address these and other needs, in one exemplary embodiment, the present invention provides a closing device which has at least one deflector element which converts movement along a first direction of the adjuster part which is movable together with the external door actuator, into movement along another direction and which may undertake a translation function at the same time. The present invention further provides a coupling element through which the deflector element acts on the operating element of the door lock which is coupled to the external door actuator. The deflector element is in direct or indirect connection with the outer skin of the vehicle door in the region of the external door actuator so that in the event of deformation of the region of the external skin on which the external door actuator is mounted, the deflector element is moved together with the external door actuator. The coupling element is provided with means for compensating the spacing, or interacts with such means. Thus, if the position of the defector element changes as a result of deformation of external skin, a movement of the deflector element relative to the operating element is enabled without the deflector element acting through the operating element on the door lock so that the vehicle door opens.

The present invention also advantageously provides that the deflector element can be attached in the region of the external door actuation on the outer skin of the vehicle door. This deflector element is, in turn, readily coupled by the coupling element to the operating element of the door lock and thus to the door lock itself. The spacing compensating means thereby ensures that in the event of deformation to the external door skin, the deflector element, together with the external door actuator, can move relative to the operating element of the lock without causing the door to open.

Another aspect of the present invention is that it enables a flexible fitting, more particularly in the case of vehicle doors in which fitting is carried out by using a door module.

The distance or spacing compensating means provided according to the invention, may be referred to as the distance compensation element and can moreover not only become active in a crash situation but can also serve as means for tolerance compensation during fitting of the door lock. As such, the distance or spacing compensating means therefore serves a double function. For the significance of the tolerance compensation when fitting a door lock reference is made to DE 196 19 869 A1.

In order to achieve the external door actuation and the deflector element moving together if the external door skin is deformed, the external door actuator and the deflector element are connected through a common structural door group to the external skin of the vehicle door which can also serve as a supporting part of the external door actuator and deflector element of a section which may be referred to as a handle dish. In one exemplary embodiment, such a structural door group may be a socket for the external door actuator, which comprises, for example, a grip indent and bearing socket.

The deflector element and coupling element may be formed by separate interconnected components or groups in which the deflector element is a rigid swivel mounted component part in one exemplary embodiment.

In one exemplary embodiment, a pulling movement is converted or reversed into a pushing movement through the deflector element. According to this exemplary embodiment, the deflector element can be at least a double-armed lever in which the adjusting part of the external door actuator engages on the one arm, and the coupling element, e.g. in the form of a coupling rod, engages on the other arm.

In another exemplary embodiment the deflector element is provided for converting linear movement of the adjuster part of the external door actuator into a rotary movement. Particularly suitable for this is a deflector element in the form of a roller which interacts with the adjuster part, which may be a toothed rod gearing or which has a curved guide slide in which a guide element that the adjuster part engages for generating a rotating movement. In one exemplary embodiment, this roller can advantageously be formed as a winder element on which a coupling element in the form of a wind-up tension member can be wound and unwound.

In another exemplary embodiment, the roller can be provided for holding a coupling element in a rotationally secured manner, and which rotates together with the roller and thus acts on the operating element of the door lock. The operating element is in this case formed as a lock follower.

The arrangement of the deflector element in the region of the external actuator may advantageously be provided so that the deflector element moves together with the external actuator should the exterior skin of the vehicle door become compressed through a crash (e.g. in the event of a front impact crash).

The distance or spacing compensating means can be designed to both permit movement of the deflector element relative to the operating element of the door lock along one direction, and also to enable movement of the deflector element relative to the operating element along two substantially opposite directions.

Thus, the distance or spacing compensating means permit a movement of the deflector element relative to the operating element of the door lock only in the direction of the space outside of the vehicle. This is advantageous if the exterior skin of the vehicle door is designed so that in particularly critical crash situations, the exterior skin of the vehicle door deforms uniformly outwards in the region of the deflector element and external door actuator.

In other cases, it may be advantageous if the distance or spacing compensating means, hereafter referred to as the distance compensating means or element, permit movement of the deflector element relative to the operating element of the door lock both in the direction of the space above the vehicle and in the direction of the interior of the vehicle.

According to another exemplary embodiment of the invention, the distance compensating means are mounted between the coupling element and the actuating element (operating element) of the door lock. The coupling element and the operating element can thereby interact through positive locking elements in the manner of a detent or ratchet coupling, e.g. through inclined teeth which permit a movement of the coupling element relative to the operating element in the direction of the exterior space of the vehicle while, during movement of the coupling element in the opposite direction, the operating element is entrained along.

According to a further exemplary embodiment of the invention the distance compensation is undertaken by the interaction of the deflector element with the coupling element. To this end a coupling element can be wound up in the manner of a wind-up tension member onto a deflector element in the form of a winding element so that during movement of the winding element in the direction of the exterior space of the motor vehicle, the coupling element can be unwound. Since a coupling element formed as a wind-up element, e.g. a cable, can only transfer traction forces and not pushing forces, this also enables a movement of the deflector element relative to the operating element of the door lock in the direction of the vehicle interior without the operating element causing the door to open.

In another exemplary embodiment, the distance compensating means may be directly integrated in the coupling element, e.g. by the coupling element having a telescopic design.

BRIEF DESCRIPTION OF THE DRAWING

Further features and advantages of the invention will now be explained with reference to the embodiments illustrated in the drawings in which:

FIGS. 1*a* to 1*c* show an exemplary embodiment of a closing device for a vehicle door, in which an external door handle is connected through a double-armed lever and a slide bar, to an operating lever of a door lock, wherein distance compensating means are mounted between the slide bar and the operating lever;

FIGS. 2*a* to 2*b* show another exemplary embodiment of a closing device for a vehicle door in which an exterior door handle is coupled through a rotatably mounted roller and a cable to the operating lever of a door lock wherein the cable can be unwound from the roller for distance compensation; and FIGS. 3*a* to 3*c* show another exemplary embodiment of a closing device for a motor vehicle door in which the exterior door handle acts through a rotatably mounted roller and coupling rod connected rotationally secured therewith, on a lock follower of a door lock in which the coupling rod has a telescopic design for distance compensation.

In FIGS. 1*a* to 1*c* an external door actuator 1 is shown fixed on exterior skin 100 of a motor vehicle door. This door actuator 1 has an exterior handle 12 attached for swivel movement to the exterior skin 100 and is connected to same through a handle dish 10 provided with a handle indent 11.

The exterior handle 12 is pretensioned by a spring element 13 shown diagrammatically in FIG. 1*b*, towards the exterior skin 100 and handle indent 11 and in order to open the vehicle door (when the door lock is unlocked), the exterior handle 12 is pulled outwards along direction R, and against the pretension of the spring element 13.

Next to the exterior handle 12 on the exterior skin 100 of the vehicle door is a locking cylinder 65 which is connected to the door lock 6 which is provided in the region of an end side 120 of the door body or, more precisely, of an inner door panel. The inner door panel extends up to a door module support 110 which is fixed on the inner door panel and which serves to hold various functional components of the vehicle door.

The exterior handle 12 has a projection 15 which projects into the interior I of the vehicle door (i.e. the space between the exterior skin 100 and the inner panel or door module support 110). When the exterior handle 12 is actuated, projection 15 is moved along direction R and together with the exterior handle 12 towards the exterior door space A. The end of the projection 15 remote from the external handle 12 is connected for articulated movement at the articulation point 21 to a deflecting element 2 which is in the form of a double-armed deflecting lever in the illustrated embodiment. The deflecting lever, i.e. deflecting element 2, is mounted for swivel movement about an axis 20 on a bearing block 25 of the handle dish 10 projecting into the interior space I of the vehicle door. The deflecting element 2 is connected by its second lever arm to a coupling element 3 through an articulation point 22. In the illustrated embodiment, coupling element 3 is a slide bar, and hereinafter may be referred to alternatively as slide bar 3 with respect to the exemplary embodiment shown in FIGS. 1*a*–1*c*.

The slide bar has a toothed section 30 which is provided with inclined teeth 31 shown in FIG. 1*c*. Through this toothed section 30 the slide bar 3 is in engagement with a sleeve 50 which has an internal toothing 51 corresponding to the inclined toothing 31. The sleeve 50 is provided on its side facing away from the toothing 51 with an integral elastic element 55 which acts on the toothed section 30 of the slide bar so that it engages continuously with the toothing 51 of the sleeve. The two toothed sections 31, 51 of the slide bar on the one side and the sleeve 50 on the other, respectively, form a ratchet coupling or detent coupling which enables movement of the slide bar (coupling element 3) relative to the sleeve 50 (against the action of the elastic section 55) towards the exterior space A of the vehicle, but during movement of the slide bar 3 in the opposite direction B, however, ensures that the sleeve 50 is entrained by the slide bar 3 or its toothed section 30.

The sleeve 50 is in turn connected (in one piece or through additional fastening means) to a lever-operating element 4 of the door lock mounted for swivel movement about an axis 40. The vehicle door can be opened when the door lock 6 is unlocked, by swivelling the external operating element 4. This takes place as follows: in order to open the vehicle door, the external handle 12 is drawn against the pretension of the spring element 13 along a direction R away from the external skin 100 of the vehicle door. The external handle 12 thereby acts through projection 15 on the deflecting element 2. This converts the pulling movement of the external handle 12 into a pushing movement of the slide bar (coupling element 3) in the opposite direction B. The slide bar thereby entrains the sleeve 50 which results in swivel movement of the external operating lever 4 about its axis 40. This enables the vehicle door to be opened in a known way.

If a crash situation (for example a front impact crash) leads to compression of the external skin 100 of the vehicle door, then it can result in a movement of the external handle 12 as well as the deflecting element 2 towards the exterior space A. The external handle 12 and the lever which is deflecting element 2 thereby move substantially in unison since they are both connected to the exterior skin 100 of the vehicle door through a common supporting part, handle dish 10. Deflecting element 2 is connected to bearing block 25. As the deflecting element 2 moves in the direction R of the exterior space A the coupling element 3 (slide bar) is entrained by the deflecting element 2 in this direction R. This movement is however not transferred to the deflecting lever 4 since the coupling element 3 can move in the direction R relative to the sleeve 50 of the external operating lever 4. As a result of the special configuration of the inclined teeth 31, 51, the sleeve 50 thus acts on the coupling element 3 on one side and the teeth 51 on the other side to permit movement of the deflecting element 2 as well as the coupling element 3 relative to the external operating lever 4 in the direction R of the external space A. In this manner, the mechanism of teeth 31, 51, sleeve 50 including elastic section 55, and coupling element 3 function as, and may be referred to as a distance compensation element 5.

The pretensioning force of the spring element 13, through which the external handle 12 is pretensioned towards the handle dish 10, is advantageously greater than the pretensioning force of the elastic element 55 which pretensions the inclined toothing 31 of the coupling element 3 in the direction of the associated toothing 51 the sleeve 50. This ensures that a crash-conditioned movement of the external door handle 12 outwards does not result in relative movement of the external operating lever 4 inwards (direction B) in relation to the external handle 12, which would lead to the vehicle door opening.

The distance compensating element 5 thus enables a compensation of crash-conditioned distance changes between the external door handle 12 and the deflecting element 2 on the one hand, and the external operating lever 4 on the other hand, without the risk of a crash-conditioned opening of the vehicle door due to the deflecting element 2 or its swivel axis 20 moving together with the external door handle 12.

If the length of the toothed section 30 of the slide bar (coupling element 3) is made sufficiently long, then the slide bar still remains in engagement with the toothing 51 of the sleeve 50 even at the end of a crash process and after distance compensation. This ensures that even after a crash the vehicle door can be opened by means of the external handle 12 and the associated gearing 2, 3, 4, 5.

In order to assemble the closing device illustrated in FIGS. 1*a* to 1*c*, the coupling element 3 may be pre-fitted together with the deflecting element 2 on the projection 15 of the external door handle 12. The toothed section 30 of the coupling element 3 can then be inserted in simple manner through the opening in the external skin 100, which is provided to receive the handle dish 10, and into the sleeve 50. Access from inside the vehicle to the component parts which are to be connected is not necessary. Assembly is therefore readily possible even if the external actuator 1 is only then fitted after a door module has been mounted on the inner door panel so that the closing device is no longer (or only under difficult conditions) accessible from inside the vehicle.

FIGS. 2*a* and 2*b* show another exemplary embodiment which is a modification of the closing device of FIGS. 1*a* to 1*c* wherein like component parts include like reference numerals and are not explained further below.

With the embodiment according to FIGS. 2*a* and 2*b* the projection 15 of the external handle 12 has a longitudinal toothing 17 which engages with an external toothing 24 of deflecting element 2' which is a rotatable guide pulley 2' in the illustrated embodiment. Deflecting element 2' may be mounted in the region of the handle dish 10, directly on the external door skin 100 or on a projection of the handle shell 10. Deflecting element 21 may alternatively be referred to as guide pulley 2' with respect to the exemplary embodiment shown as FIGS. 2*a*–2*c*. The guide pulley 2', which is rotatable about an axis 20, forms a winding element on whose winding face 23 a flexible element, such as a wire or cable or belt, is disposed. The flexible element is wound up under pretension and is fixed by its end 34 facing away from the guide pulley 2' on an external operating lever 4' which is mounted for swivel movement on the door lock. The flexible element serves as a coupling element 3' and may alternatively be referred to as flexible element 3'.

In order to hold the flexible element 3' under tension, a pretension torsion spring (not shown in FIGS. 2*a* and 2*b*) can be mounted by way of example on the winding axis 20.

In order to open the vehicle door—as already explained with respect to the previous embodiment—the external handle 12 is moved in the direction R towards the exterior space A of the vehicle whereby the projection 15 interacts through its longitudinal toothing 17 with the external toothing 24 of the deflecting element (guide pulley) 2' and generates a rotational movement D of the guide pulley 2'. The coupling element (flexible element) 3' is thereby wound onto the winding face 23 of the deflecting element (guide pulley) 2' and the external operating lever 4' of the door lock is swivelled out of its rest position against the action of a spring element 43 (tension spring) so that the door can open.

The spring element 13 acting on the external handle 12, the torsion spring which is to be mounted where necessary on the winding axis 20, and the spring element 43 which acts on the external operating lever 4', are designed in conjunction with each other so that the external operating lever 4', in the absence of external force action on the external handle 12, is located in its rest position (see FIG. 2*b*) from which it has to be swivelled out, i.e. pivot about axis 40, in order to open the door by means of the external handle 12. More particularly, the resetting force of the spring element 43 acting on the external operating lever 4' has to be sufficiently great compared with the force generated by the torsion spring, so that the external operating lever 4' returns to its rest position.

Alternatively, if the external door handle 12, the projection 15 and the deflecting element (guide pulley) 2' move in unison outwards as a result of a crash-conditioned compression of the external skin 100 of the vehicle door, then the wire which forms coupling element 3' is unwound from the pulley because the longitudinal toothing 17 of the projection 15 does not act on the external toothing 24 of the pulley 2', so that it does not result in any swivelling of the external operating lever 4'. This avoids the condition whereby the vehicle door opens outward unintentionally due to the crash-conditioned deformation of the external skin 100.

In this manner, the guide pulley 2' and the wire, which is the flexible element 3', form a distance compensation element 5' which enables a movement of the external handle 12, projection 15 and guide pulley 2' outwards without leading to a swivel movement of the external operating lever 4'.

Furthermore the door can still be opened even after a crash by means of the external handle 12 if a piece of wire is wound up onto the winding surface 23 of the guide pulley (deflecting element 2').

In the event of a crash or other event causing a deformation of the external door skin 100 inwards, then a distance compensation readily takes place between the pulley (deflecting element 2°) and the external operating lever 4' in that the tension is released from the flexible element 3' and this is wound up onto the winding face 23 of the pulley. This further ensures that, after a crash, the vehicle door can be opened further by means of the external handle 12.

Also with the present embodiment assembly is readily possible from the exterior space. The flexible element 3' is to be fixed at one end of the external operating lever 4' and can be accomplished through the opening provided in the external skin 100 for receiving the handle indent 10. No access from the interior of the vehicle is necessary for assembly.

FIGS. 3*a* to 3*c* show a further embodiment of a closing device of the present invention. In this embodiment, as with the embodiment according to FIGS. 2*a* and 2*b*, a movement of the external handle 12 in the direction R of the external space of the vehicle is converted into a rotary movement. For this purpose, the projection 15 provided on the external handle 12 is provided with a nose 18 which engages in a guide groove 27 of a pulley 2" of cylindrical outer contour 26 mounted rotatable on a bearing block 25 of the handle dish 10. In this exemplary embodiment, pulley 2" functions as the previously described deflecting element. The guide groove 27 thereby runs inclined to the cylindrical contour 26 of the pulley 2" so that a movement of the external handle 12, and thus the projection 15 as well as the nose 18 in the direction R of the external space A of the vehicle, is converted into a rotational movement D of the pulley 2" about its axis 20.

A coupling element 3" is mounted in the form of a coupling rod rotationally secured in the rotatably mounted pulley 2" where it engages by a front section 38 into a lock follower 4" of the door lock. For a rotationally secured mounting of the coupling element 3", the pulley 2" has a polygonal inner edge 28 (here in the form of a square edge) which is connected through webs 28 to the cylindrical outer contour 26 of the pulley 2". The polygonal inner edge 28 interacts with a corresponding rectangular section of the coupling element 3".

The operating lever in the form of lock follower 4" in turn is in active connection with the door lock 6 so that the door can be opened (when the door lock is unlocked) by actuating the lock follower 4" by means of the external handle 12 whereby the coupling element 3" acts in the manner described above on the lock follower 4".

According to this exemplary embodiment, the coupling element 3" is here formed as a telescopic coupling rod as it is formed by a rod 37 which is movable (longitudinally displaceable) telescopically in the polygonal inner edge 28. The coupling element 3" is thereby adjoined in the region of the handle indent 11 by a projection 14 of the handle dish 10. This projection 14 serves as a bearing for the pulley 2" and has a widened end section 14a for axially securing the pulley 2".

The coupling element 3" in the form of a rod 37 engages positively in the polygonal inner edge 28 of the pulley 2" so that it is entrained during rotary movement and can act by its front end section 38 on the lock follower 4".

If in the event of a crash situation in which the external door skin 100 is compressed so that the handle dish 10 moves outwards, then the external handle 12 including projection 15, and the projection 14 provided on the handle dish 10, move together with the pulley 2". As a result of the common movement of the projection 15 with the nose 18 on the one hand and the pulley 2" with the guide groove 27 on the other, this does not result in a rotational movement of the pulley 2". As such, lock follower 4" is not acted upon and the door does not open.

At the same time during the movement of the pulley 2" outwards, its distance from the lock follower 4" is changed. This change in distance is compensated by the coupling element 3' which executes a relative movement with respect to the pulley 2" whereby the effective length of the coupling element 3" is increased. This relative movement is thereby possible since the rod 37 of the coupling element 3" is mounted such that it is longitudinally displaceable in the pulley 2".

In the event of deformation of the external skin 100 in the direction R of the exterior space the generation of a rotational movement of the pulley 2" which could result in unintended opening of the vehicle door, is now prevented according to the exemplary embodiment illustrated in FIGS. 3*a* to 3*c*. In this situation, the pulley 2" moves outwards together with the external handle 12 and its projection 15. The change in the distance between the pulley 2" and the lock follower 4", which is thereby caused, is compensated by the telescopic coupling element 3".

In the event of deformation of the external skin 100 inwards, the projection 15 and the nose 18 provided therein likewise move inwards together with the pulley 2" which is mounted rotatable on the handle dish 10. The distance between the pulley 2" and the lock follower 4" is thereby reduced. The change in distance is compensated for by the end section 38 of the coupling element 3" associated with the lock follower 4", which is mounted with sufficient axial play Z in the lock follower 4" so that the coupling element 3" can move for distance compensation axially in the direction of the vehicle interior. Thus the distance compensation element 5" enables a distance compensation both in the event of deformation of the external skin 100 outwards and in the event of deformation inwards.

Also in this exemplary embodiment, after a crash, actuation of the lock follower 4" for opening the vehicle door by means of the external handle 12 is possible since the front end section 38 of the coupling element 3' is located as before in engagement with the lock follower 4".

Fitting the closing device can be carried out through the opening provided in the external skin 100 of the vehicle door for receiving the handle dish 10. The front end section 38 of the coupling element 3" may be brought into engagement with the lock follower 4". Further assembly steps are not required since the external actuation 1, the deflecting element 2" and the coupling element 3" can be supplied as a finished prefitted module.

A common feature of all the embodiments is that the relative movement is carried out between each two elements (deflecting element 2, 2', or 2" and external operating lever 4, 4', or 4" of the closing device which serve directly for force transfer from the external handle to the door lock.

Furthermore, in each of the aforementioned embodiments, the means for compensating distance (distance compensation element 5, 5', 5") in a crash situation can also serve at the same time as means for compensating tolerance during assembly.

What is claimed is:

1. A closing device for a vehicle door comprising:

a vehicle door with an external skin, a door lock, an operating element for actuating the door lock, an external door actuator fixed on the external skin and which has an adjuster part which moves along a first direction when the external door actuator is operated, a force transfer device through which the external door actuator is coupled to the operating element, a deflector element of the force transfer device that converts a movement of the adjuster part along the first direction to a movement along a second direction, a coupling element of the force transfer device through which the deflector element acts on the operating element, and a distance compensation element associated with the coupling element and which enables the deflector element to move relative to the operating element, wherein the external door actuator and the deflector element are connected to the external skin so that if the external skin is deformed, the external door actuator and the deflector element move substantially in unison, the distance compensation element enables movement of the deflector element relative to the operating element when a position of the deflector element changes together with the external door actuator as a result of deformation of the exterior skin, wherein the deflector element includes opposed ends and is coupled at a first end to the external door actuator that is coupled to a door handle dish and at the opposed end to the operating element by way of a ratchet coupling, the operating element forming a lever-type lock operator, wherein the deflector element is mounted for swivel movement, and wherein a linear movement of the adjuster part along the first direction is converted by the deflector element into a rotary movement of the deflector element.

2. The closing device according to claim 1, wherein the deflector element and the coupling element are separate component parts or structural groups which are in active connection with each other.

3. The closing device according to claim 1 or 2, wherein the deflector element is rigid.

4. The closing device according to claim 1, wherein a pulling movement is converted into a pushing movement or a pushing movement is converted into a pulling movement through the deflector element.

5. The closing device according to claim 1 or 4, wherein the deflector element is formed of a double-armed lever whereby the adjuster part of the external door actuator engages one arm and the coupling element engages the other arm.

6. The closing device according to claim 1, wherein the deflector element forms a guide lever.

7. A closing device for a vehicle door comprising:

a vehicle door with an external skin, a door lock, an operating element for actuating the door lock, an external door actuator fixed on the external skin and which has an adjuster part which moves along a first direction when the external door actuator is operated, a force transfer device through which the external door actuator is coupled to the operating element, a deflector element of the force transfer device which converts a movement of the adjuster part along the first direction to a movement along a second direction, a coupling element of the force transfer device through which the deflector element acts on the operating element, and a distance compensation element associated with the coupling element and which enables the deflector element to move relative to the operating element, wherein the external door actuator and the deflector element are connected to the external skin so that it the external skin is deformed, the external door actuator and the deflector element move substantially in unison, the distance compensation element enables movement of the deflector element relative to the operating element when a position of the deflector element changes together with the external door actuator as a result of deformation of the exterior skin, and the external door actuator includes a door handle having a toothed rod and the deflector element includes a pinion and a torsion-spring-tensioned cable pulley having a cable connected to the operating element, such that, when the door handle is operated, the toothed rod comes into engagement with the pinion whereby the toothed rod and pinion otherwise remain out of engagement.

8. The closing device according to claim 7, wherein the deflector element is formed of a pulley which is rotatable as a result of movement of the adjuster part along the first direction.

9. The closing device according to claim 8, wherein the deflector element is coupled to the adjuster part by a toothed rod gearing or through a guide element interacting with a guide sleeve for generating a rotary movement.

10. The closing device according to claim 8, wherein the pulley is formed as a winding element and the coupling element is a wind-up tension member that is wound and unwound.

11. The closing device according to claim 8, wherein the pulley has a socket for holding the coupling element and preventing rotational motion of the coupling element.

12. The closing device according to claim 7, wherein the deflector element and the coupling element are separate component parts or structural groups which are in active connection with each other.

13. The closing device according to claim 7, wherein the cable is unwound fully when the external door actuator and the deflector element move in a direction of the external space of the vehicle as a result of a deformation of the external skin of the vehicle door.

14. A closing device for a vehicle door comprising:

a vehicle door with an external skin, a door lock, an operating element for actuating the door lock, an external door actuator fixed on the external skin and which has an adjuster part which moves along a first direction when the external door actuator is operated, a force transfer device through which the external door actuator is coupled to the operating element, a deflector element of the force transfer device that converts a movement of the adjuster part along the first direction to a movement along a second direction, a coupling element of the force transfer device through which the deflector element acts on the operating element, and a distance compensation element associated with the coupling element and which enables the deflector element to move relative to the operating element, wherein the external door actuator and the deflector element are connected to the external skin so that if the external skin is deformed, the distance compensation element enables movement of the external door actuator, the deflector element and the coupling element substantially in unison relative to the operating element in a direction towards the exterior space of the vehicle as a result of deformation of the exterior skin of the vehicle door, wherein the deflector element includes opposed ends and is coupled at a first end to the external door actuator that is coupled to a door handle dish and at the opposed end to the operating element by way of a ratchet coupling, the operating element forming a lever-type lock operator, wherein the deflector element is mounted for swivel movement, and wherein a linear movement of the adjuster part along the first direction is converted by the deflector element into a rotary movement of the deflector element.

15. The closing device according to claim 14, wherein the deflector element and the coupling element are separate component parts or structural groups which are in active connection with each other.

16. The closing device according to claim 14 or 15, wherein the deflector element is rigid.

17. The closing device according to claim 14, wherein a pulling movement is converted into a pushing movement or a pushing movement is converted into a pulling movement through the deflector element.

18. The closing device according to claim 14 or 17, wherein the deflector element is formed of a double-armed lever whereby the adjuster part of the external door actuator engages one arm and the coupling element engages the other arm.

19. The closing device according to claim 14, wherein the deflector element forms a guide lever.

20. The closing device according to claim 14, wherein the movement of the external door actuator, the deflector element and the coupling element substantially in unison relative to the operating element in a direction towards the exterior space of the vehicle is a translation of the external door actuator, the deflector element and the coupling element substantially in unison relative to the operating element in a direction towards the exterior space of the vehicle.

21. A closing device for a vehicle door comprising:

a vehicle door with an external skin, a door lock, an operating element for actuating the door lock, an external door actuator fixed on the external skin and which has an adjuster part which moves along a first direction when the external door actuator is operated, a force transfer device through which the external door actuator is coupled to the operating element, a deflector element of the force transfer device that converts a movement of the adjuster part along the first direction to a movement along a second direction, a coupling element of the force transfer device through which the deflector element acts on the operating element, and a distance compensation element associated with the coupling element and which enables the deflector element to move relative to the operating element, wherein the external door actuator and the deflector element are connected to the external skin so that if the external skin is deformed, the external door actuator and the deflector element move substantially in unison, the distance compensation element enables movement of the deflector element relative to the operating element when a position of the deflector element changes together with the external door actuator as a result of deformation of the exterior skin, and the external door actuator includes a door handle having a projection on which a nose is formed which engages a guide groove formed on the cylinder sleeve of a pulley mounted in the door handle dish, the guide groove having an incline relative to the axis of rotation of the pulley, and wherein a coupling rod is mounted coaxially with the pulley, is axially displaceable in the pulley, engages the pulley using a key, and is connected to the operating element which is rotationally moved for actuating the door lock.

* * * * *

UNITED STATES PATENT AND TRADEMARK OFFICE

CERTIFICATE OF CORRECTION

PATENT NO. : 6,942,260 B2
APPLICATION NO. : 10/344299
DATED : September 13, 2005
INVENTOR(S) : Bücker et al.

It is certified that error appears in the above-identified patent and that said Letters Patent is hereby corrected as shown below:

On the Title Page

(73) Assignee — Delete "Brose Fahrzeugteile GmbH & Co. KG, Coburg",
Insert -- Brose Fahrzeugteile GmbH & Co. KG, Coburg, Coburg --

In the Claims

Column 10, line 50, Claim 7 — Delete "that it",
Insert --that if--

Signed and Sealed this

Fifth Day of December, 2006

JON W. DUDAS
*Director of the United States Patent and Trademark Office*